US005293672A

United States Patent [19]

Tominaga et al.

[11] Patent Number: 5,293,672

[45] Date of Patent: Mar. 15, 1994

[54] GAS-AND-WATER-TIGHT FLEXIBLE FASTENER

[75] Inventors: Yutaka Tominaga, Toyama; Mitsuru Akeno, Kurobe, both of Japan

[73] Assignee: Yoshida Kogyo K. K., Tokyo, Japan

[21] Appl. No.: 33,366

[22] Filed: Mar. 18, 1993

[30] Foreign Application Priority Data

Mar. 30, 1992 [JP] Japan ..... 4-17763

[51] Int. Cl.[5] ..... A44B 19/00; B65D 33/00

[52] U.S. Cl. ..... 24/587; 24/400; 383/63

[58] Field of Search ..... 24/587, 576, 399, 400; 411/508, 510; 363/63, 64, 65

[56] References Cited

U.S. PATENT DOCUMENTS

| | | | |
|---|---|---|---|
| Re. 28,969 | 9/1976 | Naito . | |
| 3,347,298 | 10/1967 | Ausnit et al. | 383/65 |
| 3,806,998 | 4/1974 | Laguerre | 24/400 |
| 3,808,649 | 5/1974 | Ausnit | 383/63 |
| 4,947,525 | 8/1990 | Van Erden | 24/587 |

FOREIGN PATENT DOCUMENTS

| | | |
|---|---|---|
| 2341452 | 2/1975 | Fed. Rep. of Germany . |
| 778594 | 7/1957 | United Kingdom . |

*Primary Examiner*—Victor N. Sakran

*Attorney, Agent, or Firm*—Hill, Steadman & Simpson

[57] ABSTRACT

A gas-and-water-tight flexible fastener comprises an plug being of a arrow-shaped cross-section and including a shaft and a head mounted on a front end of the shaft, the head having a pair of locking fins formed at the proximal ends so as to be directed rearward and outwardly; and a socket being of a squared C-shaped cross-section and including a base, a pair of substantially parallel side plates integrally formed with the base, the side plates having a pair of locking hooks formed along their respective confronting distal edges so as to be directed rearward and inwardly for locking engagement with the locking fins when the plug is forced into the socket between the opposed locking hooks, and resilient partition interposed between the opposed side plates for defining an inner hollow and an outer locking groove.

4 Claims, 3 Drawing Sheets

GAS-AND-WATER-TIGHT FLEXIBLE FASTENER

BACKGROUND OF THE INVENTION

1. Field of the Invention

The present invention relates generally to a gas-and-water-tight elongated flexible fastener used on water-proof bags, water-proof canvases, raintight cover and the like and particularly to a gas-and-water-tight elongated flexible fastener comprising an elongated plug and an elongated socket which can be firmly coupled together so that the fastener is improved in gas-and-water-tightness.

2. Description of the Prior Art

There are two types of gas-and-water-tight elongated flexible fasteners described above. The first type is disclosed in Japanese Patent Publication No. 37-12467. This type of fastener comprises a plug and a socket adapted to be coupled together. The elongated plug has a coupling head adapted for coupling engagement with the socket and having an elongated inner hollow formed thereon. The elongated socket has a coupling groove adapted for coupling engagement with the coupling head of the plug and an elongated inner hollow formed behind the coupling groove. Since the coupling head and the coupling groove are generally round in contour, the fastener itself does not provide sufficient gas-and-water-tightness. For sufficient gas-and-water-tightness, both inner hollows of the socket and plug must be supplied and inflated with pressurized fluid after the coupling head of the plug comes into coupling engagement with the coupling groove of the socket, thereby swelling the coupling head and contracting the coupling groove so that the head-and-groove coupling engagement becomes the tighter and the fastener enjoys increased gas-and-water-tightness.

The second type of fastener is disclosed in Japanese Utility Model Publication No. 4-3965. The second type of fastener comprises an arrow-shaped plug and a socket to be coupled therewith. The plug has an arrow-head-shaped head which in turn has a pair of locking fins formed on its opposed sides. The socket has a pair of symmetrical hook portions facing each other to define therebetween a coupling groove. The hook portions terminate with the respective hook ends which face each other. In addition, the hook portions have at the middle portions their respective tongues projecting toward each other. The head of the plug is thrusted into the groove of the socket until the opposed locking fins of the plug comes into locking engagement with the respective hook ends of the socket with the projecting tongues resting against the opposed sides of the plug head so that the fastener enjoys gas-and-water-tightness.

However, the above-mentioned two types of fasteners suffer from the respective drawbacks.

In the first type of fastener, for sufficient gas-and-water-tightness, both inner hollows of the socket and plug must be supplied and inflated with pressurized fluid after the coupling head of the plug comes into coupling engagement with the coupling groove of the socket, as mentioned earlier. This makes the coupling operation tedious and time-consuming. Not only this, the inflation of pressurized air into the inner hollow renders the plug and socket extremely stiff, thereby making difficult the manipulation of the fastener.

In the second type of fastener, when the plug are trusted into coupling engagement with the socket, the opposed locking fins of the plug comes into locking engagement with the respective hook ends of the socket with the projecting tongues resting against the opposed sides of the plug head so that the fastener enjoys gas-and-water-tightness, as mentioned hereinabove. However, the projecting tongues are deficient in urging the head of the plug outward, so that the fastener could lose gas-and-water-tightness depending on how severely the fastener is used. For example, if the fastener is subjected to severe distortion or other severe stresses, the fastener is very likely to lose gas-and-water-tightness.

SUMMARY OF THE INVENTION

With the foregoing difficulties in view, it is therefore an object of the present invention to provide a gas-and-water-tight elongated flexible fastener in which the above-mentioned drawbacks have been fully overcome.

It is another object of the present invention to provide a gas-and-water-tight elongated flexible fastener in which gas-and-water-tightness can be maintained under whatever condition the fastener may be used.

According to the present invention, there is provided a gas-and-water-tight flexible fastener comprising: an plug being of a substantially arrow-shaped cross-section and including a shaft and a head mounted on a front end of the shaft, the head having a pair of locking fins formed at the proximal ends so as to be directed rearward and outwardly; and a socket being of a substantially squared C-shaped cross-section and including a base, a pair of substantially parallel side plates one integrally formed with and extending perpendicularly from each end of the base, the side plates having a pair of locking hooks formed along their respective confronting distal edges so as to be directed rearward and inwardly for locking engagement with the locking fins when the plug is forced into the socket between the opposed locking hooks, and resilient means interposed between the opposed side plates for defining an inner hollow and an outer locking groove.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
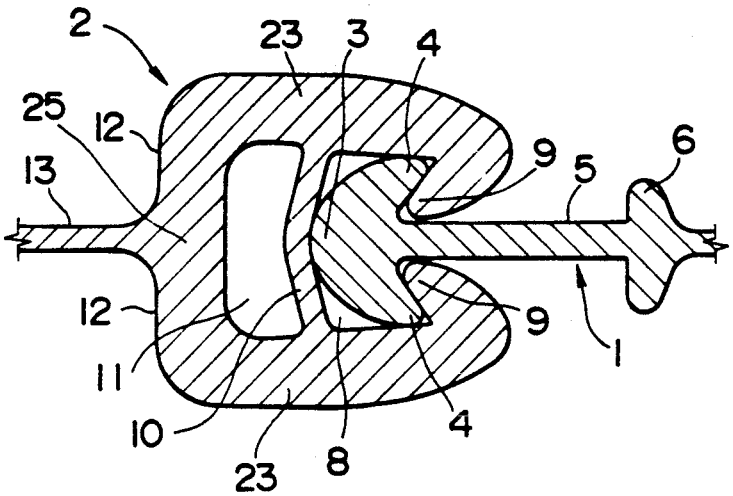
FIG. 1 is an enlarged cross-sectional view of a gas-and-water-tight elongated flexible fastener according to the present invention and showing the fastener in coupled disposition.
Figure 2:
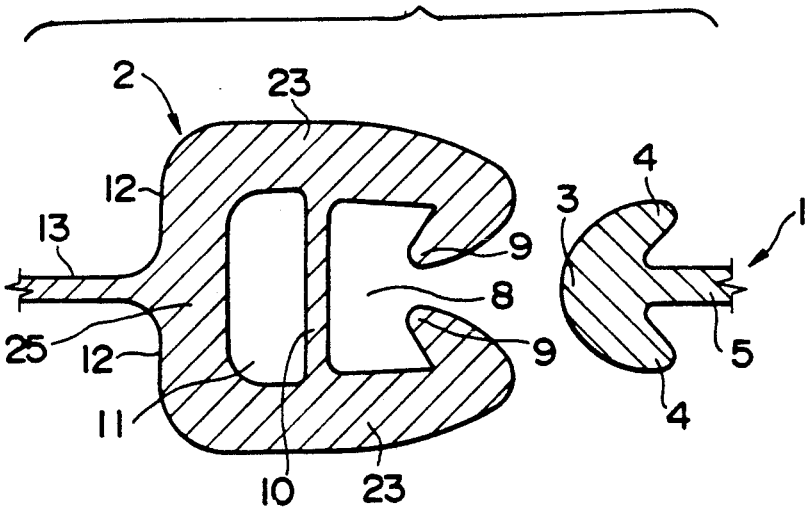
FIG. 2 is a view similar to FIG. 1 but showing the fastener in uncoupled disposition.

Referring now to FIGS. 1 and 2, a gas-and-water-tight elongated flexible fastener according to the present invention is extrusion-molded of thermoplastic plastic. The fastener broadly comprises an elongated plug or male member 1 and an elongated socket or female member 2 adapted for coupling engagement with the elongated plug 1.

The elongated plug 1 is of a substantially arrow-shaped cross-section. The plug 1 includes a shaft 5 and a head 3 mounted on a front end of the shaft 5. The head 3 has a pair of locking fins 4 formed at the proximal end one on each side of the shaft 5 and directed rearwardly and outwardly. The shaft 5 has a pair of ridges 6, 6 mounted in its intermediate position one on each side of the shaft 5. The ridges 6, 6 function to guide a slider (not shown) when the slider reciprocate along the fastener. In case of a fastener of the type devoid of slider wherein the plug 1 and socket 2 are coupled manually or without aid of a slider, such guiding ridges 6, 6, may be omitted.

The elongated socket 2 is of a substantially squared C-shaped cross-section. The socket 2 generally comprises a base 25 and a pair of substantially parallel side plates 23, 23 one integrally formed with and extending substantially perpendicularly from each end of the base 25. The side plates 23, 23 have a pair of locking hooks 9, 9 formed along their respective confronting distal edges and directed rearwardly and inwardly. The locking fins 4, 4 of the plug 1 come into locking engagement with the locking hooks 9, 9 of the socket 3, when the plug 1 is thrusted into coupling engagement with the socket 3.

Importantly, the socket 2 further has a resilient partition 10 integrally formed therewith. The resilient partition 10 is interconnected with the side plates 23, 23 at the intermediate points so as to extend substantially parallel with the base 25, thereby defining an inner hollow 11 and an outer locking groove 8 close to and remote from, respectively, the base 25. The depth of the outer groove 8 is such that, when the plug 1 is fully coupled with the socket 2, the resilient partition 10 urges the head 3 of the plug 1 outward. This assures that the locking fins 4, 4 of the plug 1 is urged into more tight engagement with the looking hooks 9, 9 of the socket 3.

The socket 2 further includes a stem 13 mounted on the base 25 at the middle so as to extend rearward from the base 25. The outer surface 12 of the base 25 of the socket 3 functions to guide a slider (not shown) when the slider reciprocate along the fastener.

Figure 4:
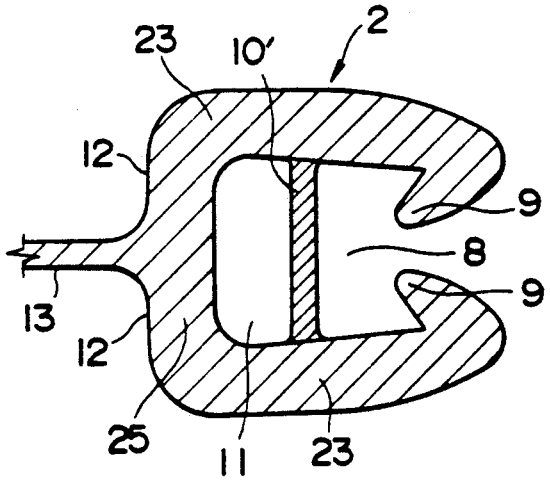
FIG. 4 is an enlarged cross-sectional view of a socket of a gas-and-water-tight elongated flexible fastener according still another embodiment of the present invention.

As shown in FIG. 4, the resilient partition 10 may be molded from a different material than that of the remaining part of the socket 2; that is, different plastics having different rigidity.

Figure 5:
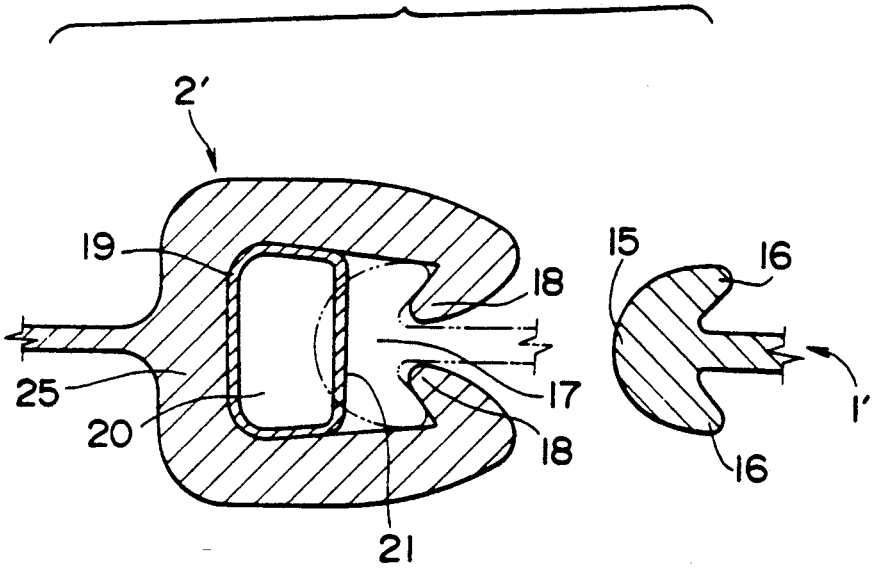
FIG. 5 is a view similar to FIG. 1 but showing yet another embodiment of the present invention.

FIG. 5 shows another embodiment of the present invention. This embodiment is substantially identical with the preceding embodiment except that the squared C-shaped cross-sectioned socket 2' has a gutter 17 formed throughout its length and that, instead of provision of the resilient partition 10, a hollow rectangular tube 19 of resilient material is snugly fitted into the gutter 17 and adhered to the inner sides thereof. That side 21 of the rectangular tube 19 which remains intact or unadhered does the same function as the resilient partition 10. That is, when the plug 1' is coupled with the socket 2', the intact side 21 of the resilient rectangular tube 19 functions to urge the head 15 of the plug 1' outward.

In case of a large-sized gas-and-water-tight fastener, it is optional whether the hollow rectangular tube 19 is adhered to the inner sides of the gutter 17.

Figure 3:
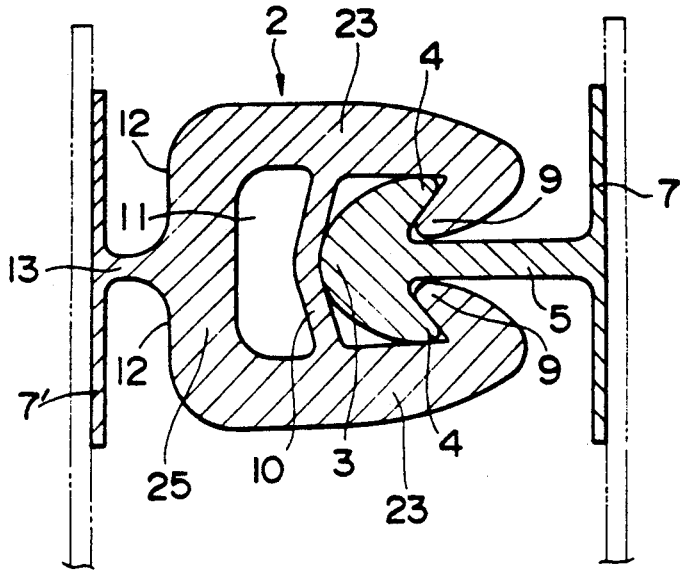
FIG. 3 is also a view similar to FIG. 1 but showing another embodiment of the present invention.

For joining two flat sheets disposed edge-to-edge in one and the same plane, the fastener according to the preceding embodiments will do. However, for joining two flat sheets disposed surface-to-surface, the plug 1 and the socket 2 of the fastener further includes their respective attachment sills 7, 7'. As shown in FIG. 3, the attachment sill 7' is mounted on the distal end of the stem 13 of the socket 2 so as to extend perpendicularly therefrom. Likewise, the attachment sill 7 is mounted on the distal end of the shaft 5 of the plug 1 so as to extend perpendicularly therefrom. The attachment sills 7, 7' of the plug 1 and the socket 2 are adhered to the internal surfaces of the opposed sheets.

In operation, the head 3 of the plug 1 is forced into the inner groove 8 of the socket 2 between the opposed locking hooks 9, 9 as spreading the locking hooks 9, 9 apart against the resiliency of the socket 2 until the locking fins 4 of the plug 1 pass beyond the locking hooks 9, 9 of the socket 2 with the head 3 pressing the resilient partition 10, at which moment the locking hooks 9, 9 restores to the original position under the resiliency of the socket 2, coming into locking engagement with the locking fins 4, 4 of the plug 1.

In this coupling disposition, the resilient partition 10 urges the head 3 of the plug 1 outward. Furthermore, the resilient means 10, 10', 21, as pressed and deformed by the head 3 of the thrusting plug 1, contracts the opposed side plates 23, 23 and hence the confronting hooks 9, 9 of the socket 2. This advantageously ensures that the locking fins 4, 4 of the plug 1 come into more tight engagement with the looking hooks 9, 9 of the socket 3.

With the construction set forth hereinabove, the fastener according to the present invention enjoys very good gas-and-water tightness no matter how severely the fastener may be used.

Furthermore, an ordinary flexible fastener can be easily transformed into a gas-and-water tight fastener by mere insertion of a resilient tube into the socket of the fastener.

Still furthermore, if more tightness is desired, it is possible to inflate the hollow with pressurized fluid.

Obviously, the skilled person would realize that various modifications and variations of the present invention are possible in the light of the above teaching. It is therefore to be understood that within the scope of the appended claims the invention may be practiced otherwise than as specifically described and that the invention is not limited to the embodiments described above in detail.

What is claimed is:

1. A gas-and-water-tight flexible fastener comprising:

an plug being of a substantially arrow-shaped cross-section and including a shaft and a head mounted on a front end of the shaft, the head having a pair of locking fins formed at the proximal ends so as to be directed rearward and outwardly; and a socket being of a substantially squared C-shaped cross-section and including a base, a pair of substantially parallel side plates one integrally formed with and extending perpendicularly from each end of the base, the side plates having a pair of locking hooks formed along their respective confronting distal edges so as to be directed rearward and inwardly for locking engagement with the locking fins when the plug is forced into the socket between the opposed locking hooks and resilient means interposed between the opposed side plates for defining an inner hollow and an outer locking groove.

2. A gas-and-water-tight flexible fastener according to claim 1, the hollow-defining resilient means comprising a resilient partition integrally formed with the socket and interconnected with the side plates at the intermediate points so as to extend substantially parallel with the base.

3. A gas-and-water-tight fastener according to claim 2, the resilient partition being molded from a different material than that of the remaining part of the socket.

4. A gas-and-water-tight flexible fastener according to claim 1, the squared C-shaped cross-sectioned socket having a gutter formed throughout its length, the hollow-defining resilient means comprising a hollow tube snugly fitted into the gutter and adhered to the inside thereof.

* * * * *